United States Patent [19]

Gombault

[11] Patent Number: 4,553,459

[45] Date of Patent: Nov. 19, 1985

[54] METHODS AND AN APPARATUS FOR TRILATERALLY OPENING AN ENVELOPE

[75] Inventor: Jacobus F. Gombault, Drachten, Netherlands

[73] Assignee: Hadewe B.V., Drachten, Netherlands

[21] Appl. No.: 548,079

[22] Filed: Nov. 2, 1983

[30] Foreign Application Priority Data

Nov. 9, 1982 [NL] Netherlands ..... 8204336

[51] Int. Cl.[4] ..... B43M 7/00

[52] U.S. Cl. ..... 83/36; 83/705; 83/706; 83/912; 198/410; 53/381 R

[58] Field of Search ..... 83/36, 912, 705, 706, 83/708–712; 271/225, 184–185, DIG. 9, 236, 250–251; 53/381 R; 198/410; 414/754

[56] References Cited

U.S. PATENT DOCUMENTS

| | | | |
|---|---|---|---|
| 3,143,100 | 8/1964 | Krupotich | 83/912 X |
| 3,238,926 | 3/1966 | Huck | 83/912 X |
| 4,233,800 | 11/1980 | Long | 83/912 X |

*Primary Examiner*—James M. Meister

*Assistant Examiner*—John L. Knoble

*Attorney, Agent, or Firm*—Kenyon & Kenyon

[57] ABSTRACT

A method of opening an envelope along three edges, in which the envelope is moved to an opening or edge removing device along a supply path, one edge being guided along said device for cutting open or removing the edge. Next, the envelope is rotated through 90° to be subsequently guided again along the opening or edge removing device for opening the second edge, which cycle is repeated for the third edge. An apparatus for performing this method includes a housing having an inlet path leading to the supply path along which the opening or edge removing device is arranged, a first set of members for moving and guiding the envelope co-extensively with the inlet path, and a second set of members for moving and guiding the envelope in a direction perpendicular to the inlet path along the opening or edge removing device, and a third set of members for guiding and moving the envelope along a quarter-circular path, which returns the envelope, turned 90 degrees, to the first set of members in the inlet path.

13 Claims, 11 Drawing Figures

FIG.3
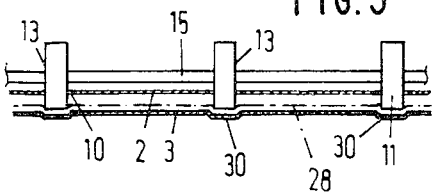
FIG.4
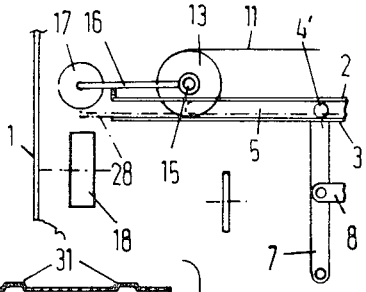
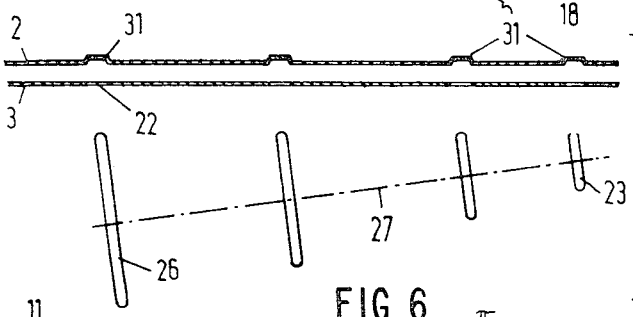
FIG.5
FIG.6
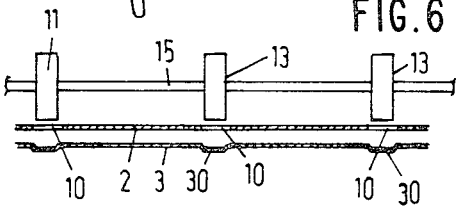
FIG.7
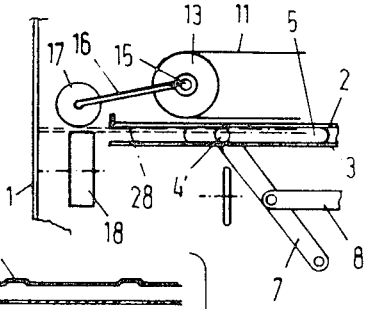
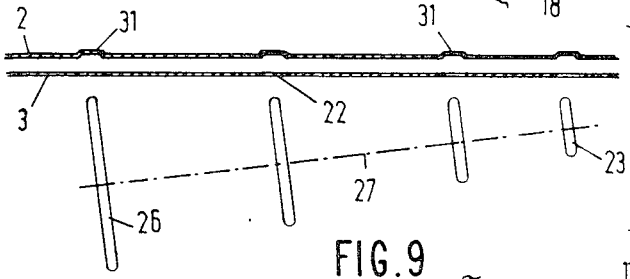
FIG.8
FIG.9
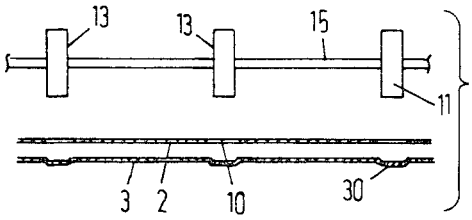
FIG.10
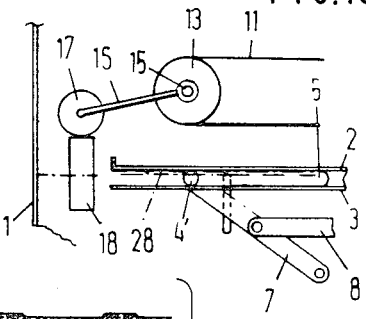
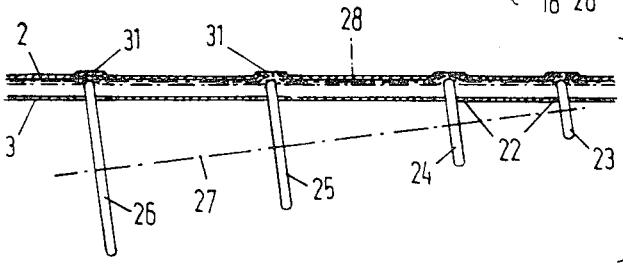
FIG.11

METHODS AND AN APPARATUS FOR TRILATERALLY OPENING AN ENVELOPE

The invention relates to a method for trilaterally opening an envelope, in which the envelope is moved to an opening or edge removing device along a supply path, one edge thereof being guided along said device for cutting open or removing the edge, and a second and a third edge subsequently are respectively guided a second and a third time along an opening or edge removing device, as well as to an apparatus for performing this method.

The advantage of such a preparation of an envelope in handling large quantities of mail relative to the conventional, unilateral opening is a substantial gain in time in extracting the contents. This method also offers better possibilities of visually checking for any documents remaining in the envelopes. In spite of these striking advantages, the use of such envelope handling apparatus has remained very limited, which can be attributed to the required complicated apparatus, the size and the high cost thereof. The known methods and apparatus all use a continuous conveyor belt, along which the required opening and tilting operations are performed. In this manner, true, a maximum handling speed can be obtained, but this also means an extensive apparatus with many precision devices.

It is an object of the invention to remove the above drawbacks by simplifying the operations to be carried out during the trilateral opening, so that it will be sufficient to use less extensive and less complicated apparatus.

This is achieved according to the invention in a method of the above described type when after the opening or removal of the first edge the envelope is rotated through 90° in order to be guided subsequently again along the opening or edge removing device along the supply path for opening the second edge, which cycle is repeated for the third edge.

By causing an envelope to follow this handling path, only one supply path, one opening device and one rotating device is necessary. The method according to the invention thus makes it possible to provide a compact apparatus with a minimum of precision devices. True, the operating speed relative to apparatus having a continuous conveyor belt and trilateral opening apparatus is reduced, by the handling speed remains so high that the apparatus can keep pace with at least two persons, even if these perform only the simplest operations.

If, according to a further embodiment of the invention, the rotation of the envelope through 90° is performed by causing the envelope, after leaving the opening or edge removing device, to describe a quarter-circular path, the initial direction of said path extending perpendicularly to the edge of the envelope treated immediately previously, the rotation and returning to the supply path can be combined with advantage. On the one hand, the advantages reside in a shortened handling duration and on the other hand in a minimized return path length, which is advantageous in respect of the extent of the apparatus. A minimized supply path length can be realized if, in accordance with a still further embodiment of the invention, a first movement is imparted to the envelope by the supply path in a direction perpendicular to the next edge to be treated and thereafter a second movement in the direction of the edge to be treated, to beyond the opening or edge removing device, thus advantageously creating the possibility for the supply path and the quarter-circular path to form a closed circuit, thereby to realize the smallest possible path of displacement for the envelope.

If the opening has to be done by one or two persons, it is preferable, according to the invention, that after treatment of the third edge the envelope is guided along the quarter-circular path to the supply path and is discharged via the latter by a reversed first displacement. For this purpose, a first trilaterally opened envelope is removed from the supply path, after which a new envelope to be opened is to be introduced in the supply path and the contents of the opened envelope can be inspected or passed on to further treatment stations.

The invention also relates to an apparatus for performing the method according to the invention. In an apparatus comprising a housing having an envelope inlet connected to a supply path, along which an opening or edge removing device is arranged, it is preferable, according to the invention that the supply path comprises a first set of members for displacing and guiding the envelope in a first direction co-extensively with the inlet and a second set of members for displacing and guiding the same in a direction perpendicular to the first direction and beyond and along the opening or edge removing device, said second set of members being connected to a third set of members for guiding and displacing the same along a quarter-circular path, said third set of members providing a path connection to the first set of members downstream of the inlet, by means of which there is obtained a very compact apparatus with a minimum of precision devices, in particular only one opening or edge removing device. The guidance and transport within the apparatus can be realized in a relatively simple manner if guide portions of the three sets of members are formed by two plates, which are interspaced in such a manner as to form an envelope-receiving slot, and have apertures and/or slots for the passage of displacement portions of the members, such as rollers and belts. The assurance of a proper location of the envelope can be increased by proper, successive engagement with the envelope by the displacement portions, if in accordance with a still further embodiment of the invention, the displacement portions of the first and the third set of members and/or the two plates are arranged for movement perpendicular to the plates, so that in a first position the displacement portions of the first set of members extend through the one plate into the receiving slot, in a second position no displacement portions extend into said slot, and in a third position the displacement portions of the third set of members extend through the other plate into the receiving slot, the displacement portions of the second set of members, placed in operative position, linking up with said receiving slot in the second position. These features ensure that in the successive positions, only the required displacement portions can engage with the envelope. A relatively simple construction can be effected if the plates are arranged movably and the displacement portions have a stationary arrangement, since in that case only one control mechanism, i.e. that for the two plates, is necessary for obtaining the desired effect, while, if required, the displacement portions can be driven continuously.

The removal of an envelope from the apparatus can be effected in a simple manner, without additional transport and guide members, if the displacement portions of the first set of members are drivable in two opposite directions.

The combination of the rotation of the envelope through 90° and its return to the return path can be effected in a reliable and relatively simple manner if the displacement portions of the third set of members comprise wheels fixedly mounted on radially arranged, driven shafts, with the diameters of the wheels increasing with the radius of their position in the arcuate path.

The orientation of the envelope relative to the opening or edge removing device, as well as the proper contact with and engagement by the displacement portions of the second set of members can be realized in an advantageous and structurally simple manner if, according to still another embodiment of the invention, the displacement portions of the second set of members are adapted for coaction with counterpressure elements which are pivotally disposed and which are steerable by the plates in such a way that the counterpressure elements are, when the apparatus is in the first position, spaced apart from the displacement portions of the second set of members and, when the apparatus is in the second position, can effect a transporting action therewith.

The method and apparatus for trilaterally opening an envelope according to the invention will now be described, with reference to an embodiment shown by way of example, in the accompanying diagrammatic drawings, in which.

Figure 1:
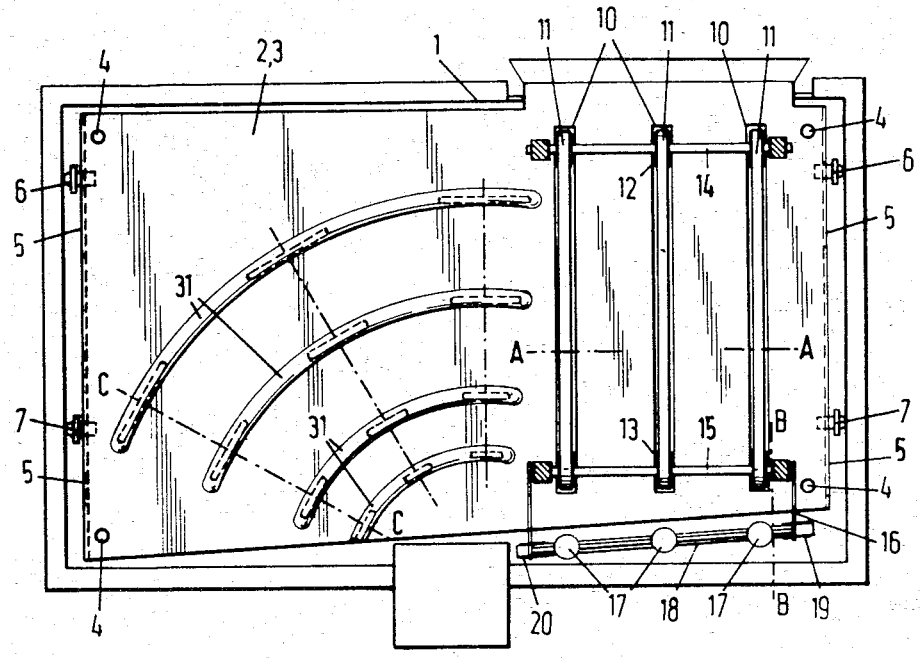
FIG. 1 is a top view of an apparatus according to the invention.

FIGS. 3, 4, and 5 are cross-sections on the lines A—A, B—B and C—C respectively, of FIG. 1, with the apparatus being in a first position;

FIGS. 6, 7, and 8 are cross-sections on the lines A—A, B—B and C—C respectively, of FIG. 1, with the apparatus being in a second position; and FIGS. 9, 10, and 11 are cross-sections on the lines A—A, B—B and C—C respectively, of FIG. 1, with the apparatus being in a third position.

Figure 2:
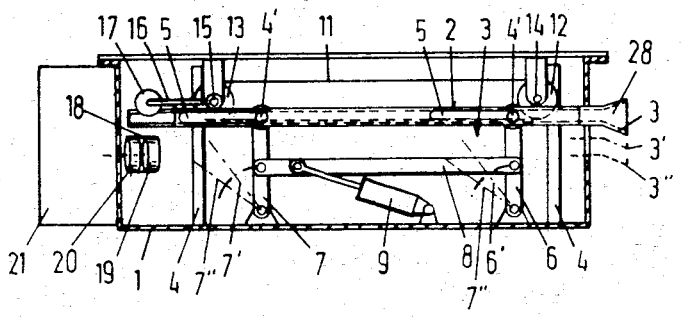
FIG. 2 is a side view of the apparatus shown in FIG. 1.

The apparatus shown in the drawings comprises a housing 1 in which are accommodated two parallel plates 2 and 3 spaced a fixed distance apart and movably mounted on vertical pins 4. Extending between the plates 2 and 3 are rollers 4, which connect the plates 2 and 3 via slots 5 to pivotable support rods 6 and 7 for sliding and pivotal movement relative thereto, the other ends of which rods are pivotally connected to the housing 1. The rods 6 and 7 are interconnected by a rod 8, which is movable substantially in its longitudinal direction by means of a actuator device 9. The actuator device 9 is capable of placing the rods 6 and 7, and hence the plates 2 and 3 coupled thereto, in three positions. FIG. 2 shows these positions of the rods at 6,7; 6', 7', and 6'' and 7'', respectively. The positions of the plate 3 associated with these rod positions are indicated by 3,3' and 3'', respectively.

The plate 2 comprises slots 10, through which can extend conveyor belts 11, These belts run about reversing rollers 12,13, both the reversing rollers 12 and the reversing rollers 13 being rotatable with respective common shafts 14, 15 arranged in a stationary relationship in the housing.

Pivotally mounted on the shaft 15 is an arm 16, which is substantially U-shaped and carries counterpressure elements 17. Opposite the counterpressure elements 17 there is provided a conveyor belt 18, which extends about reversing rollers 19,20.

An opening or edge removing device 21 is positioned co-extensively with the conveyor belt 18.

The plate 3 contains four arcuate slots 22 of different radii, through which respective conveyor rollers 23–26 can extend. Each set of conveyor roller 23–26 is mounted on a different common shaft 27, with the rollers having increasing diameters starting from conveyor roller 23.

The operation of the apparatus will now be described with reference to FIGS. 3–11, showing the apparatus in the three positions shown in FIG. 2.

In FIGS. 3–5 the plates 2 and 3 are in the position shown in solid lines in FIG. 2. As shown in FIG. 3, at least a part of each of the conveyor rollers 11 extends through the corresponding slot 10 in plate 2 to adjacent the plate 3. An envelope 29 supplied to the apparatus through inlet opening 28 is pressed against the plate 3 and is further introduced into the apparatus by means of the conveyor belts 11. For the purpose of a proper contact between envelope and conveyor belts, the plate 3 may be provided with troughs 30, as shown in FIG. 3, opposite the slots 10.

The conveyor belts 11 transport the envelope until the leading area thereof arrives between the counterpressure elements 17 and the conveyor belt 18. This is detected by a suitable signalling element, which transmits a control signal to the actuator device 9, which brings the plates 2 and 3 to the second position pivoting the rods 6,7 to the positions 6' and 7' shown in FIG. 2.

The second position of the apparatus is shown in more detail in FIGS. 6–8. Due to the displacement of the plates 2 and 3, the conveyor belts 11 have been retracted from the area enclosed by the two plates. This plate displacement also results in the pivoting about the shaft 15 of the arm 16 resting on the plate 2. As a result of this pivoting movement of the arm 16, the counterpressure elements 17 come into contact with the upper surface of the envelope 29, the under surface of which is supported on the upper part of the conveyor belt 18, which has become aligned with the plate 3 due to the lowering of this plate. The envelope 29 will thus be guided towards and along the opening or edge removing device 21, where the initially leading edge is cut open or removed.

At the end of this treatment a control signal is delivered to the actuating device 9, which moves the plates 2,3 to the third position, shown in FIG. 2 by the positions 6'' and 7'' for the rods 6 and 7.

This third position is shown in FIGS. 9–11, in which the conveyor rollers 23–26 positioned initially underneath the plate 3 extend through the slots 22 in the plate 3 to adjacent the plate 2. In the position, the conveyor rollers 23–26 engage the envelope 29, while again troughs 31 may be provided but now in plate 2 for an optimal contact. Due to this transport operation, the envelope will describe a quarter-circular path, thus arriving underneath the conveyor belts 11 in a position rotated through 90° relative to its initial position. By means of a signalling element and the actuator device 9, the apparatus will be returned to the first position shown in FIGS. 3–5, after which in a further cycle the then leading edge of the envelope 29 is removed. After a third circulation through the apparatus, a third edge will have been removed, the transport direction of the conveyor rollers 11 can be reversed by means of the signalling element, and the envelope can be ejected, after which the apparatus is ready to receive the next envelope to be opened.

It is observed that the design of the supply path in two substantially perpendicular portions has the advantage that envelopes of various formats can be treated without any problems. The transport members of the first conveyor belt portion will always ensure the complete alignment of the edge to be treated with the transport members of the second conveyor belt portion before the envelope comes into contact with the opening or edge removing device.

The continuous contact of an envelope with the pressing transport members supported by the plates has the advantage that even after removal of one, two or three edges, the envelope remains closed in such a manner that ejection of the contents from the envelope is effectively prevented. This effect is optimized by the troughs 30,31 provided in the plates 2,3, owing to which the envelope with contents will assume a slightly corrugated cross-sectional profile.

It is self-evident that many modifications and variants are possible within the scope of the invention. For instance, the conveyor belts 11,18 may be replaced by conveyor rollers, while the counterpressure elements could be designed as conveyor belt or conveyor rollers. A number of alternatives are possible also for the conveyor rollers 23–26. For instance, the rollers could all have the same diameter, but, depending on their radial positioning, could be driven at different speeds. Also, the rollers 23 could be replaced by a chain which follows the path of the slot 22. Naturally, even in such a case the rollers 24,25,26 could be replaced by a chain. If it is undesirable that the envelope is discharged from the apparatus at the same place where it is supplied, an outlet beside the opening or edge removing device 21 would also be possible. It is observed that by means of an appropriate control sequence, the apparatus could also serve for opening an envelope along only one or two sides. Finally, it is observed that the actuator device 9 could directly engage the plates 2,3 in order to move the plates to the three desired positions.

I claim:

1. A method of cutting open more than one edge of an envelope, the method including conveying the envelope disposed in a first orientation along a supply path to contact an edge opening device for cutting open a first edge of the envelope, and subsequently transporting the envelope for cutting open at least a second edge thereof, wherein said step of subsequently transporting the envelope comprises:

returning the envelope to a location on the supply path upstream of said edge opening device after cutting open the first edge;

rotating the envelope in its own plane by 90 degrees to a second orientation wherein the second edge is located in a position corresponding to that of the first edge in the first orientation; and conveying the envelope along the same supply path to contact the same edge opening device for cutting open the second edge.

2. A method according to claim 1 wherein the step of subsequently transporting the envelope further comprises:

after cutting open the second edge, again returning the envelope to said location on the supply path upstream of said edge opening device;

rotating the envelope in its own plane by a further 90 degrees to a third orientation; and conveying the envelope along the same supply path to contact the same edge opening device for cutting open a third edge of the envelope.

3. A method according to claim 1 or 2 wherein the step of rotating the envelope in its own plane by 90 degrees comprises:

transporting the envelope along a quarter-circular path, the initial direction of said quarter-circular path being transverse to the edge of the envelope opened in the preceding step.

4. A method according to step 1 or 2 wherein the step of conveying the envelope along the supply path to contact the edge opening device comprises:

displacing the envelope in a first direction perpendicular to the next edge to be opened and thereafter displacing the envelope in a second direction parallel to the next edge to be opened, past and in contact with the edge opening device, to a location beyond the edge opening device.

5. A method according to claim 4 wherein the steps of returning the envelope to the supply path and of rotating the envelope in its own plane 90 degrees together comprise transporting the envelope along a quarter-circular path, the initial direction of said quarter-circular path being transverse to the envelope edge opened in the preceding step, and the final direction of the quarter-circular path intersecting said supply path, such that the supply path and the quarter-circular path form a closed circuit.

6. A method according to claim 5, the method further comprising, after displacing the envelope in the second direction parallel to the last edge to be opened to a location beyond the edge opening device, transporting the envelope along the quarter-circular path to said supply path and displacing the envelope along the supply path in a third direction opposite to the first direction for discharging said envelope.

7. Apparatus for cutting open more than one edge of an envelope, the apparatus including a housing having an inlet to a supply path and an edge opening device located for contacting by an edge of an envelope conveyed along the supply path, a first set of members for conveying an envelope along the supply path in a first direction leading from the inlet, and a second set of members for subsequently conveying the envelope along the supply path in a second direction perpendicular to the first direction, past and in contact with the edge opening device, to a location beyond the edge opening device, wherein the improvement comprises a third set of members for transporting the envelope from the location beyond the edge opening device along a quarter-circular path returning to the first set of members on the supply path.

8. Apparatus according to claim 7 wherein the first, second, and third sets of members comprise:

guide portions formed by two parallel plates spaced apart to provide an envelope-receiving slot, the plates being provided with apertures along said supply path and said quarter-circular path; and envelope-displacing portions engageable with an envelope through said apertures for conveying the envelope along said supply path and said quarter-circular path.

9. Apparatus according to claim 8 wherein the envelope-displacing portions of the first set of members are drivable in two opposite directions.

10. Apparatus according to claim 8 wherein the envelope-displacing portions of the third set of members comprise sets of axially spaced wheels mounted on angularly spaced radially disposed shafts, with the diameters of the wheels in each set being proportional to the radial location of the wheels on the corresponding shaft.

11. Apparatus according to claim 8, the apparatus further comprising:

means for providing relative movement between the two parallel plates and the envelope-displacing portions of the first and third set of members in a direction perpendicular to the plates for selecting a first relative position wherein the envelope-displacing portions of the first set of members extend through corresponding ones of the apertures in one plate into the envelope-receiving slot, a second relative position wherein the envelope-displacing portions of the second set of members are operatively associated with the envelope-receiving slot, and a third relative position wherein the envelope-displacing portions of the third set of members extend through the other plate into the envelope-receiving slot.

12. Apparatus according to claim 11 wherein the means for providing relative movement between the two parallel plates and the envelope displacing portions of the first and third set of members is coupled between the pair of plates and the housing to move the plates relative to the housing, the envelope-displacing portions being maintained stationary with respect to the housing.

13. Apparatus according to claim 11 or 12, the apparatus further comprising counterpressure elements adapted to coact with the envelope-displacing portions of the second set of members, the counterpressure elements being pivotally mounted so as to be spaced apart from the envelope-displacing portions of the second set of members when the plates and envelope-displacing portions are in the first relative position, and so as to be able to mutually engage an envelope in cooperation with the envelope-displacing portions of the second set of members when the plates and envelope-displacing portions are in the second relative position.

* * * * *

UNITED STATES PATENT AND TRADEMARK OFFICE

CERTIFICATE OF CORRECTION

PATENT NO. : 4,553,459

DATED : 19 November 1985

INVENTOR(S) : Jacobus F. GOMBAULT

It is certified that error appears in the above-identified patent and that said Letters Patent is hereby corrected as shown below:

| | |
|---|---|
| ABSTRACT, line 13: | after "path," delete "and". |
| TITLE PAGE : | change "METHODS" to --METHOD--. |
| Column 1, line 2: | change "METHODS" to --METHOD--. |
| Column 1, line 48: | change "by" to --but--. |
| Column 2, line 20: | after "invention" insert --,--. |
| Column 3, line 53: | change "a actuator" to --an actuator--. |
| Column 4, line 7: | change "roller 23-26" to --rollers 23-26--. |
| Column 4, line 30: | after "position" insert --by--. |
| Column 4, line 47: | after "treatment" insert --,--. |
| Column 6, line 11: | change "step 1" to --claim 1--. |
| Column 6, line 22: | after "plane" insert --by--. |

Signed and Sealed this

*Twenty-seventh* Day of *May 1986*

[SEAL]

*Attest:*

DONALD J. QUIGG

*Attesting Officer* *Commissioner of Patents and Trademarks*